United States Patent [19]

Steinberger

[11] Patent Number: 4,592,265

[45] Date of Patent: Jun. 3, 1986

[54] FOLDABLE LEG REST FOR STRINGED MUSICAL INSTRUMENT

[75] Inventor: Ned Steinberger, Cornwall, N.Y.

[73] Assignee: Steinberger Sound Corporation, Newburgh, N.Y.

[21] Appl. No.: 678,036

[22] Filed: Dec. 4, 1984

[51] Int. Cl.[4] ..... G10G 5/00

[52] U.S. Cl. ..... 84/327

[58] Field of Search ..... 84/280, 281, 327, 328

[56] References Cited

U.S. PATENT DOCUMENTS

| | | | |
|---|---|---|---|
| Re. 31,722 | 11/1984 | Steinberger | 84/327 |
| 672,444 | 4/1901 | Haile | 84/327 |
| 774,750 | 11/1904 | Gladieux | 84/273 |
| 1,261,841 | 4/1918 | Mortensen | 84/327 |
| 1,285,802 | 11/1918 | Russell | 84/327 |
| 1,802,236 | 4/1931 | Carroll et al. | 84/327 X |
| 1,945,162 | 1/1934 | Rasmussen | 84/327 |
| 2,133,356 | 10/1938 | Luttbeg | 84/376 |
| 2,208,824 | 7/1940 | Weinberg | 84/280 |
| 2,746,336 | 5/1956 | Bisharat | 84/280 |
| 2,884,828 | 5/1959 | Montenare | 84/327 |
| 3,102,446 | 9/1963 | Raleigh | 84/327 |
| 3,366,293 | 1/1968 | Fyke | 224/5 |
| 3,372,614 | 3/1968 | Galster | 84/280 |
| 3,512,443 | 5/1970 | Parson et al. | 84/313 |
| 3,955,461 | 5/1976 | Ivie | 84/327 |
| 4,213,369 | 7/1980 | Swartwout | 84/284 |
| 4,339,981 | 7/1982 | Smith | 84/291 |

*Primary Examiner*—Lawrence R. Franklin

*Attorney, Agent, or Firm*—Finnegan, Henderson, Farabow, Garrett and Dunner

[57] ABSTRACT

A foldable leg rest for a stringed musical instrument, the instrument including a body portion having a substantially planar lower surface when the instrument is oriented in a playing position. The leg rest includes a base member for attachment to the lower surface, an elongated substantially flat support member, a hinge mechanism for pivotally connecting the support member to the base member, and a bistable device for alternately biasing the support member into a closed position wherein the support member lies flat against the lower surface of the instrument, and an open position wherein the support member extends downwardly at an angle from the lower surface of the instrument for resting the instrument on the leg of a seated musician, the leg rest having no substantial from the lower surface of the instrument when the support member is in the closed position for maintaining a substantially streamlined appearance of the body.

3 Claims, 5 Drawing Figures

FIG. 1.
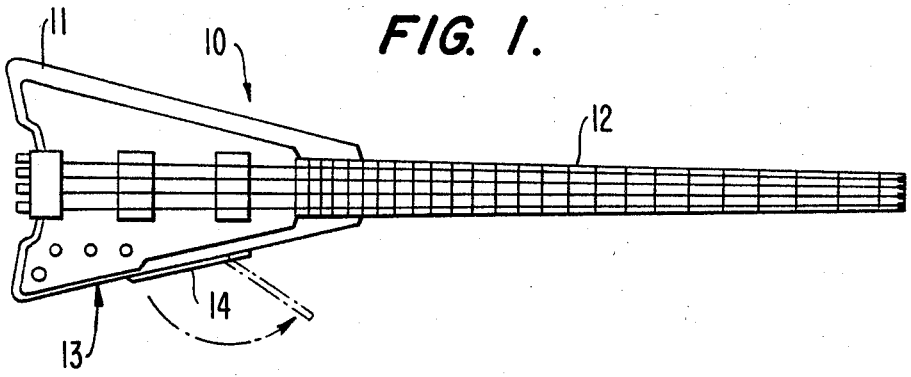
FIG. 2.
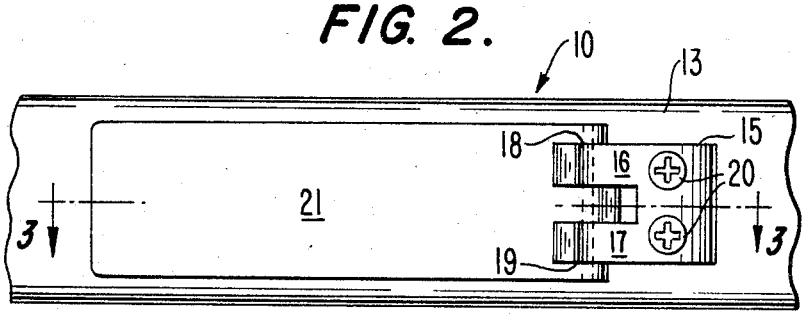
FIG. 3.
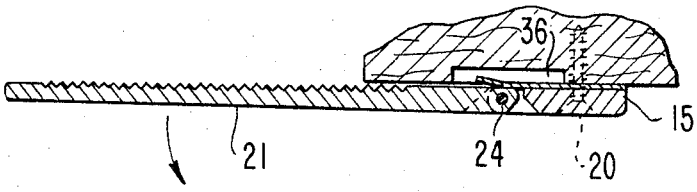
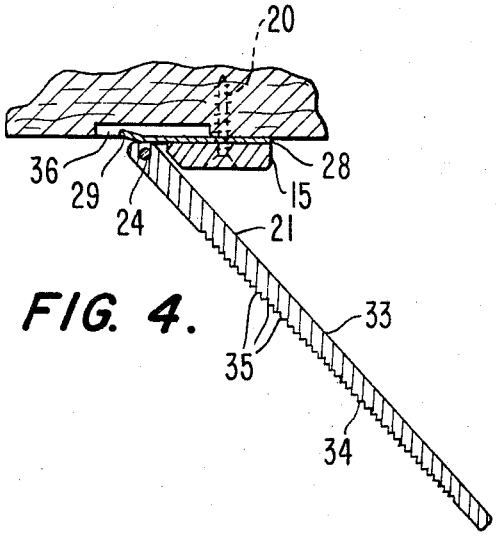
FIG. 4.
FIG. 5.
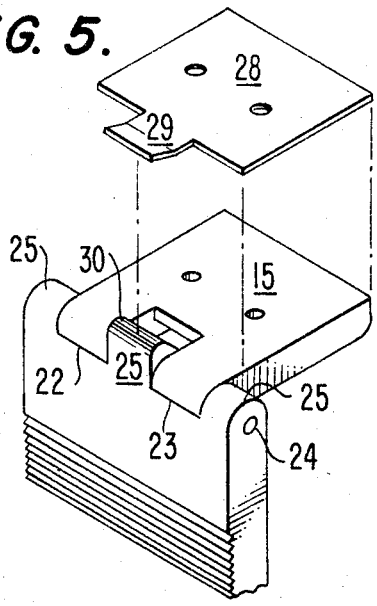

FOLDABLE LEG REST FOR STRINGED MUSICAL INSTRUMENT

FIELD OF THE INVENTION

This invention relates to apparatus for stabilizing or supporting a stringed musical instrument on the leg of a seated musician. More specifically, the invention relates to a leg rest for a stringed musical instrument which is foldable between open and closed positions.

BACKGROUND OF THE INVENTION

Leg rests have been utilized in the prior art for supporting instruments on the leg of a seated musician for many years. For example, Gladieux U.S. Pat. No. 774,750 describes a combined support and tone modulating device for musical instruments which includes a supporting arm shaped to rest upon the thigh or knee of a banjo player for supporting the banjo head. The position of the supporting arm may be adjusted in two directions by a screw which clamps the arm into a final position.

Mortensen U.S. Pat. No. 1,261,841 discloses a banjo knee rest which is mounted to a pair of blocks. When not in use, the rest may be removed from the banjo, and the blocks are small enough so that they do not project in a manner which interferes with the packing of the banjo.

Russell U.S. Pat. No. 1,285,802 discloses a guitar rest which clamps to the neck of the guitar for supporting it on the leg of a musician. The rest is removed when not in use.

Rasmussen U.S. Pat. No. 1,945,162 describes a guitar support which includes an elongated and outwardly curved rest arm pivoted to a flexible strap attached to the periphery of a stringed instrument. Additional supports and leg rests are disclosed in Ivie U.S. Pat. No. 3,955,461, Montenare U.S. Pat. No. 2,884,828, and Luttberg U.S. Pat. No. 2,133,356.

Although the prior art devices are useful in supporting various types of instruments on the leg of a musician, most of these devices require manual adjustments in order to place the support in an operative position, or require dismounting of the device when it is not in use. In addition, many of these devices are visually unappealing, and serve to disturb the overall appearance of a streamlined instrument body.

Accordingly, it is an object of the present invention to provide a simple and effective leg rest device for a stringed musical instrument which may be left in a mounted position on the instrument, when not in use, and which is quickly and easily placed in its open position ready for use.

It is a further object of this invention to provide a leg rest which is easily opened and closed, and which provides no substantial protuberance from the lower surface of the instrument on which it is mounted when the leg rest is in the closed position.

It is a further object of this invention to provide a leg rest which maintains a substantially streamlined appearance of the body of a stringed musical instrument with the leg rest mounted on the instrument in a closed position.

Additional objects and advantages of the invention will be set forth in part in the description that follows, and in part will be obvious from the description, or may be learned by practice of the invention.

SUMMARY OF THE INVENTION

To achieve the foregoing objects and in accordance with the purpose of the invention as embodied and broadly described herein, the leg rest of this invention is for a stringed musical instrument including a body portion having a substantially planar lower surface when the instrument is oriented in a playing position. The leg rest of the invention includes a base member for attachment to the lower surface; an elongated substantially flat support member; hinge means for pivotally connecting support member to the base member; and bistable means for alternately biasing the support member into a closed position wherein the support member lies flat against the lower surface of the instrument, and an open position wherein the support member extends downwardly at an angle from the lower surface for resting the instrument on the leg of a seated musician. The leg rest has no substantial protuberance from the lower surface of the instrument when the support member is in the closed position for maintaining a substantially streamlined appearance of the body.

Preferably, the bistable means includes a leaf spring, and the support member includes a projection on the hinged end thereof for interacting with the spring for biasing the support member. It is also preferred that the support member include an outer face and an inner face, the inner face having a plurality of grooves thereon for reducing slippage of the leg rest on the leg of a seated musician when the support member is in the open position.

BRIEF DESCRIPTION OF THE DRAWINGS

The accompanying drawings which are incorporated in and constitute a part of this specification, illustrate one embodiment of the invention, and, together with the description, serve to explain the principles of the invention.

OF THE DRAWINGS

FIG. 1 is a front view of a stringed musical instrument on which the leg rest of the invention has been installed;

FIG. 2 is an enlarged cutaway bottom view of the instrument with the leg rest in the closed position.

FIG. 3 is a cross-sectional view taken along the line 3—3 of FIG. 2;

FIG. 4 is a view similar to FIG. 3 wtth the leg rest in the open position; and FIG. 5 is an exploded perspective view of the leg rest showing the positioning of the leaf spring.

DESCRIPTION OF THE PREFERRED EMBODIMENT

Reference will now be made in detail to the present preferred embodiment of the invention, an example of which is illustrated in the accompanying drawings.

As shown in FIG. 1, the invention is a leg rest for a stringed musical instrument, the instrument including a body portion having a substantially planar lower surface when the instrument is oriented in a playing position. In accordance with the invention, the leg rest comprises a base member for attachment to the lower surface; an elongated substantially flat support member; hinge means for pivotally connecting the support member to the base member; and bistable means for alternately biasing the support member into a closed position wherein the support member lies flat against the lower surface of the instument, and an open position wherein the support member extends downwardly at an angle from the lower surface for resting the instrument on the leg of a seated musician. The leg rest has no substantial protuberance from the lower surface of the instrument when the support member is in the closed position for maintaining a substantially streamlined appearance of the body of the instrument. In the illustrated embodiment, a stringed musical instrument 10 has a body portion 11 and a neck portion 12. The body portion 11 includes a substantially planar lower surface 13 when the instrument is oriented in a playing position. The leg rest 14 attaches to the lower surface 13 of the instrument 10, as described hereinafter.

As shown in FIGS. 2–5, the leg rest includes a base member 15 for attachment to the lower surface 13 of the instrument 10. The base member 15 has two legs 16 and 17 which give it a substantially U-shaped configuration. A pair of bores 18 and 19 pass through the legs 16 and 17. The base member 15 may be attached to the lower surface 13 of the guitar 10 by a suitable means, for example, screws 20.

In accordance with the invention, the leg rest includes an elongated substantially flat support member. As here embodied, the support member includes a generally rectangular metal plate 21 having a thickness generally corresponding to the thickness of the base member 15. Hinge means are provide for pivotally connecting the support member 21 to the base member 15. As shown in FIGS. 2–5, the support member 21 has two cutout portions 22 and 23 on one end thereof. These cutout portions 22 and 23 are sized to fit over the legs 16 and 17 of the base member 15. A bore 24 passes through the upstanding portions 25 of the support member 21 for alignment with the bores 18 and 19 of the base member. A suitable pin 26 may be inserted through the bores 18, 19 and 24 to allow pivotal movement of the support member 21 on the base member 15.

In accordance with the invention, bistable means are provided for alternately biasing the support member into a closed position wherein the support member lies flat against the lower surface of the instrument, and an open position wherein the support member extends downwardly at an angle from the lower surface for resting the instrument on the leg of a seated musicfan. As embodied herein, the bistable means includes a leaf spring 28 mounted between the base member 15 and the lower surface of the instrument 13. The leaf spring 28 has a finger 19 thereon for interacting with the support member 21. A projection 30 on the hinged end of the support member 21 interacts with the finger 29 of the leaf spring 28 for biasing the support member. The projection 30 is shaped to interact with the finger 29 for biasing the support member 21 into a closed position with the support member 21 lying against the lower surface 13 of the instrument 10. The shape of the projection 30 also biases the support member in an open position with the support member extending downwardly at an angle from the lower surface 13 of the instrument 10 for resting the instrument on the leg of a seated musician. When the leg rest is in the closed position, there is no substantial protuberance from the lower surface 13 of the instrument 10. Thus, a substantially streamlined appearance of the body 11 is maintained, since the leg rest 14 does not have a thickness sufficient to disturb the overall lines of the instrument 10.

The support member 21 preferably includes an outer face 33 and an inner face 34, and inner face 34 may be provided with a plurality of grooves 35 thereon for reducing slippage of the leg rest on the leg of a seated musician when the support member 21 is in the open position.

In order to provide sufficient space for the movement of the leaf spring 28 in response to pivotal rotation of the support member 21, a small space 36 may be cut out of the lower surface 13 of the instrument 10. This space 36 is typically made very small, and is almost entirely covered by the leg rest 14. The space 36 allows the finger 29 on the spring 28 to move upwardly during pivotal rotation of the support member 21 on the base member 15.

The leg rest 14 may be formed of any suitable material, such as metal or high grade plastic.

Thus, the invention provides a practical and useful device which may be economically manufactured, and which meets a need in the industry for simplicity and utility. While the preferred embodiment described is particularly used with an electric guitar, the invention may be used with any stringed musical instrument which has a substantially planar lower surface when the instrument is oriented in a playing position.

It will be apparent to those skilled in the art that various modifications and variations could be made in the invention without departing from the scope or spirit of the invention.

What is claimed is:

1. A leg rest for a stringed musical instrument, the instrument including a body portion having a substantially planar lower surface when the instrument is oriented in a playing position, the leg rest comprising:

a base member for attachment to said lower surface;

an elongated substantially flat support member;

hinge means for pivotally connecting said support member to said base member; and bistable means for alternately biasing said support member into a closed position wherein said support member lies flat against the lower surface of said instrument, and an open position wherein said support member extends downwardly at an angle from said lower surface for resting said instrument on the leg of a seated musician, said leg rest having no substantial protuberance from said lower surface of said instrument when said support member is in said closed position for maintaining a substantially streamlined appearance of said body.

2. The leg rest of claim 1 wherein said bistable means includes a leaf spring, and said support member includes a projection on the hinged end thereof for interacting with said leaf spring for biasing said support member.

3. The leg rest of claim 2 wherein said support member includes an outer face and an inner face, the inner face having a plurality of grooves thereon for reducing slippage of said leg rest on the leg of a seated musician when said support member is in the open position.

* * * * *